US006196023B1

(12) United States Patent
Corduan et al.

(10) Patent No.: US 6,196,023 B1
(45) Date of Patent: Mar. 6, 2001

(54) METHOD AND DEVICE FOR PRODUCING COMPRESSED NITROGEN

(75) Inventors: Horst Corduan, Puchheim; Dietrich Rottmann, Munich; Juergen Voit, Schondorf; Christian Kunz; Wolfgang Haag, both of Munich, all of (DE)

(73) Assignee: Linde Aktiengesellschaft, Wiesbaden (DE)

( * ) Notice: Subject to any disclaimer, the term of this patent is extended or adjusted under 35 U.S.C. 154(b) by 0 days.

(21) Appl. No.: 09/297,380

(22) PCT Filed: Oct. 30, 1997

(86) PCT No.: PCT/EP97/06010

§ 371 Date: Apr. 30, 1999

§ 102(e) Date: Apr. 30, 1999

(87) PCT Pub. No.: WO98/19122

PCT Pub. Date: May 7, 1998

(30) Foreign Application Priority Data

| | | |
|---|---|---|
| Oct. 30, 1996 | (DE) | 196 43 916 |
| Feb. 17, 1997 | (EP) | 97102533 |
| Apr. 23, 1997 | (DE) | 197 17 124 |
| Aug. 13, 1997 | (DE) | 197 35 154 |

(51) Int. Cl.[7] ..... F25J 1/00
(52) U.S. Cl. ..... 62/650; 62/653
(58) Field of Search ..... 62/653, 650, 646

(56) References Cited

U.S. PATENT DOCUMENTS

| | | | | |
|---|---|---|---|---|
| 4,717,410 | * | 1/1988 | Grenier | 62/653 |
| 5,098,457 | | 3/1992 | Cheung et al. . | |
| 5,303,556 | * | 4/1994 | Dray et al. | 62/653 |
| 5,402,647 | * | 4/1995 | Bonaquist et al. | 62/653 |

FOREIGN PATENT DOCUMENTS

| | | |
|---|---|---|
| 3528374 | 2/1987 | (DE) . |
| 2578532 | 9/1986 | (FR) . |

* cited by examiner

*Primary Examiner*—Ronald Capossela
(74) *Attorney, Agent, or Firm*—Evenson, McKeown, Edwards & Lenahan, P.L.L.C.

(57) ABSTRACT

The process and the apparatus serve to produce pressurized nitrogen by low-temperature fractionation of air in a rectification system which has a pressure column (4) and a low-pressure column (5). Feed air (1, 3) is passed into the pressure column (4). An oxygen-containing liquid fraction (11) is taken off from the pressure column (4) and fed into the low-pressure column (5). Gaseous nitrogen (18) from the low-pressure column (5) is at least partially condensed in a top condenser (17) by indirect heat exchange with an evaporating liquid (13). Nitrogen from the low-pressure column is produced as gaseous pressurized nitrogen product (24, 25, 29) at a pressure which is higher than the operating pressure of the low-pressure column (5). Liquid nitrogen (20) withdrawn from the low-pressure column is brought (21) in the liquid state to a pressure which exceeds the pressure of the low-pressure column (5). The pressurized liquid (22) is evaporated in a product evaporator (23) by indirect heat exchange with a heat-transfer medium (35) and is subsequently produced as gaseous pressurized nitrogen product (24, 25, 29). (FIG. 1)

15 Claims, 9 Drawing Sheets

METHOD AND DEVICE FOR PRODUCING COMPRESSED NITROGEN

BACKGROUND AND SUMMARY OF INVENTION

The invention relates to a process for producing pressurized nitrogen by low-temperature fractionation of air in a rectification system which has a pressure column and a low-pressure column, in the process, feed air being passed into the pressure column, an oxygen-containing liquid fraction being taken off from the pressure column and fed into the low-pressure column, gaseous nitrogen from the low-pressure column being at least partially condensed in a top condenser by indirect heat exchange with an evaporating liquid and nitrogen from the low-pressure column being produced as gaseous pressurized nitrogen product at a pressure which is higher than the operating pressure of the low-pressure column.

A process of this type is disclosed by DE 3528374 A1. Here, nitrogen produced in particular at the top of the low-pressure column is removed as pressurized product. In addition, the nitrogen is taken off in the gaseous state from the low-pressure column, heated in the main heat exchanger against feed air and then compressed from about low-pressure column pressure to the product pressure.

The object underlying the invention is to produce nitrogen at high pressure with relatively little expenditure.

This object is achieved by means of the fact that at least a part of the liquid nitrogen produced in the indirect heat exchange in the top condenser or liquid nitrogen withdrawn from the low-pressure column is brought in the liquid state to a pressure which exceeds the pressure of the low-pressure column, is evaporated in a product evaporator by indirect heat exchange with a heat-transfer medium and is produced as pressurized nitrogen product. The product evaporator can be disposed within one of the columns or outside the columns.

The pressure increase in the nitrogen product from the low-pressure column is therefore at least partially carried out in the liquid state. The pressure increase in the liquid can be carried out by any known measure, for example by means of a pump, utilization of a hydrostatic potential and/or pressurizing evaporation in a tank. It implies a lower expenditure on apparatus than a gas compressor. Indirect heat exchange is additionally required in which the low-pressure column nitrogen pressurized in the liquid state is evaporated. Nevertheless, this gives overall a particularly economically favourable process.

In comparison with take-off of the pressurized nitrogen product directly from the pressure column, the process according to the invention additionally has the advantage of higher product purity. In particular, in the low-pressure column, a concentration of more volatile components such as helium, neon and/or hydrogen can be achieved which is decreased in comparison with the top product of the pressure column. Preferably, in the invention all of the nitrogen product of the low-pressure column is taken off in the liquid state from the low-pressure column or from its top condenser.

The operating pressures of the double column in the process according to the invention can be for example 6 to 20, preferably 7 to 16, bar in the pressure column and, for example 3 to 8, preferably 3 to 6, bar in the low-pressure column. The top condenser of the low-pressure column is operated, for example, with a liquid from the low-pressure column, such as, for instance, the low-pressure column bottom-phase liquid, as refrigerant. Reflux for the pressure column is usually produced by a condenser/evaporator, via which the top of the pressure column and the bottom of the low-pressure column are in heat-exchanging connection.

There are two preferred possibilities for the choice of the heat-transfer medium for evaporating the low-pressure column nitrogen pressurized in the liquid state.

Firstly, a gas from the pressure column, preferably a nitrogen-containing fraction from an upper or central region of the pressure column, can be used as heat-transfer medium. This can be the top fraction of the pressure column or a gas which is withdrawn at an intermediate point of the pressure column. This intermediate point is situated below the pressure column top by a number of theoretical plates which is up to 5/6, preferably 1/3 to 5/16, of the total number of theoretical plates within the pressure column. The condensate produced in the indirect heat exchange in the product evaporator is recycled at least in part, preferably completely, back to the pressure column and there used as reflux.

Alternatively, or additionally, a gas from the low-pressure column is used as heat-transfer medium for evaporating the low-pressure column nitrogen pressurized in the liquid state, preferably an oxygen-containing fraction from a lower or central region of the low-pressure column. This can be the bottom-phase fraction of the low-pressure column or a gas which originates from an intermediate point of the low-pressure column. This intermediate point is situated above the low-pressure column bottom by a number of theoretical plates which is up to 5/6, preferably 1/3 to 5/6, of the total number of theoretical plates within the low-pressure column. The condensate produced in the indirect heat exchange in the product evaporator is recycled at least in part, preferably completely, back to the low-pressure column.

In addition, it is expedient if the liquid nitrogen only evaporates in part in the indirect heat exchange in the product evaporator and the portion of the nitrogen which remains liquid is returned to the low-pressure column. The product evaporator in this case is preferably operated as a falling-film evaporator. This type of evaporation makes a particularly low temperature difference possible and thus a correspondingly high evaporation pressure which, even when pure nitrogen from the top of the pressure column is used as heat-transfer medium, is only slightly (about 0.3 to 0.8 bar) below the pressure column pressure. The circulation pump used is the pump present in any case for pressure boosting; the low-pressure column serves as flash gas separator when the portion which remains liquid is recycled.

To produce refrigeration it is conventional to subject a process fraction to work-producing expansion. In the context of the invention it is advantageous if the energy produced in the work-producing expansion is used for further compression of the pressurized nitrogen product downstream of the product evaporator. The pressurized nitrogen product from the low-pressure column can thus be brought to pressure column pressure with low expenditure and mixed with nitrogen product withdrawn directly from the pressure column. The mixture can be used as product or compressed to a still higher pressure. The process fraction to be subjected to work-producing expansion can be a partial stream of the feed air, evaporated refrigerant from the top condenser of the low-pressure column or a gas from the lower region of the low-pressure column.

Usually, the bottom-phase liquid of the low-pressure column is used as refrigerant to condense the gaseous nitrogen from the low-pressure column in the top condenser of the low-pressure column. However, if in the context of the process according to the invention, in addition to the pressurized nitrogen, relatively pure or pure oxygen (purity greater than 40 mol %, in particular greater than 80 mol % or greater than 90 mol %, preferably between 99.5 and 99.999 mol %) is to be produced, it is particularly expedient if a liquid fraction whose oxygen content is between that of the oxygen-containing liquid fraction from the pressure column and that of the bottom-phase liquid of the low-pressure column, is used to condense the gaseous nitrogen from the low-pressure column in the top condenser. This can be the oxygen-containing liquid fraction from the pressure column itself or a liquid produced after its expansion to about low-pressure column pressure, or else a liquid fraction which is taken off from the low-pressure column above the bottom, but below the feed of the oxygen-containing liquid fraction. In this manner, a pure oxygen product can be taken off in the liquid and/or gaseous state from the lower region of the low-pressure column, more precisely at the superatmospheric pressure of the low-pressure column. The refrigerant for the top condenser of the low-pressure column nonetheless has a higher nitrogen content than the oxygen product and thus a relatively low evaporation temperature.

The invention and other details of the invention are described in more detail below with reference to illustrative examples shown in the drawings. In the drawings:

DETAILED DESCRIPTION OF DRAWINGS

Figure 1:
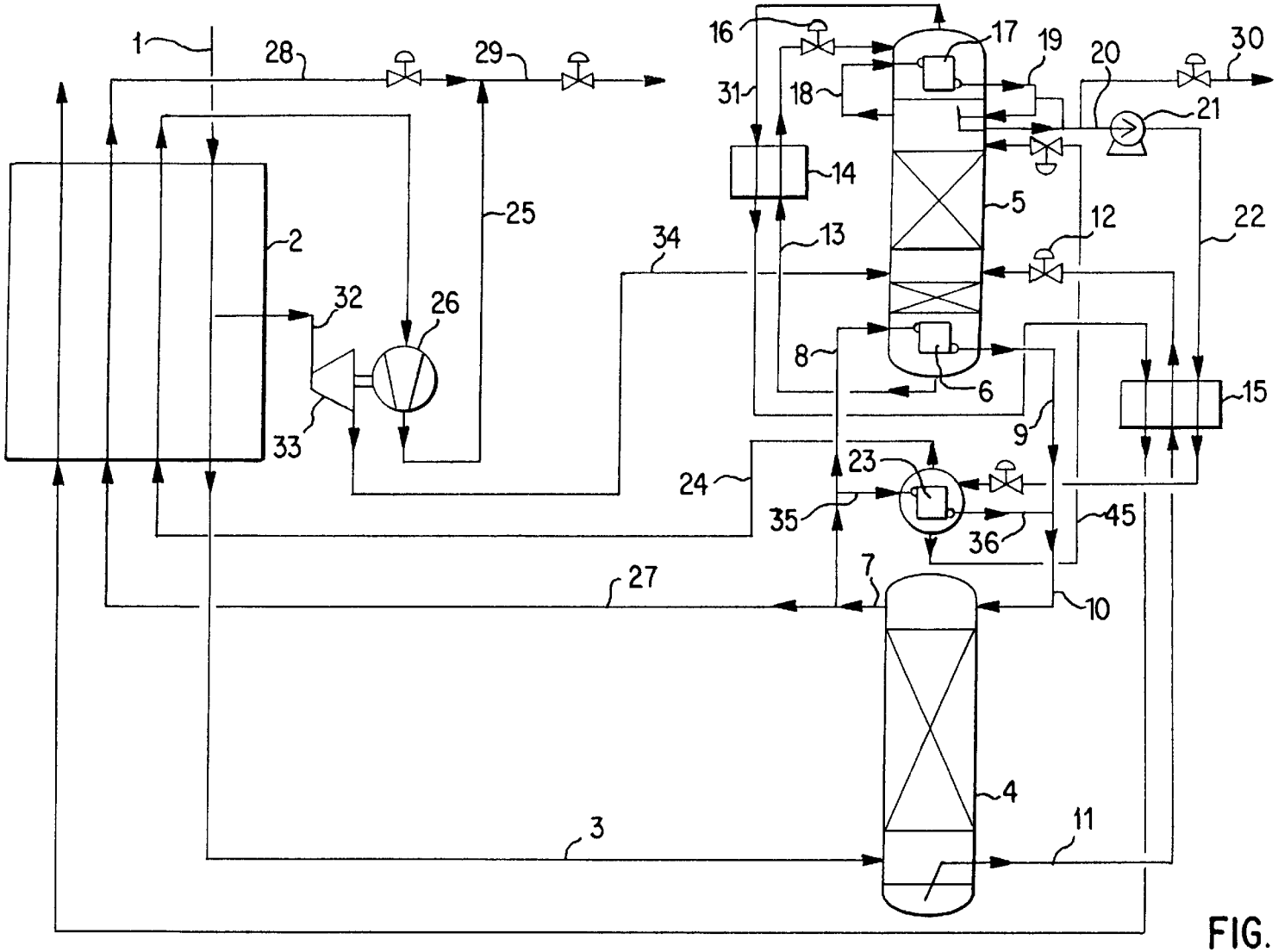
FIG. 1 shows a first illustrative example of the process according to the invention and a corresponding apparatus having a product evaporator which is disposed outside the columns and is operated with vapour from the pressure column.

In the process of FIG. 1, compressed and purified air 1 is cooled in a main heat exchanger 2 and fed to a pressure column 4 at a pressure of 14 bar (3). The rectification system additionally has a low-pressure column 5, which is operated at a pressure of 5 bar and is in heat-exchanging connection with the pressure column via a shared condenser/evaporator (main condenser) 6. A part 8 of the nitrogen taken off at the top of the pressure column is liquefied in the main condenser 6 and passed as reflux to the pressure column via the lines 9 and 10. Bottom-phase liquid 11 of the pressure column is, after subcooling 15, throttled (12) as oxygen-rich liquid fraction into the low-pressure column 5. The bottom-phase liquid 13 of the low-pressure column 5 is likewise subcooled (14) and expanded (16) and then introduced into the evaporation chamber of the top condenser 17 of the low-pressure column 5. In its liquefaction chamber, gaseous nitrogen 18 from the top of the low-pressure column 5 condenses; a first part of the condensate 19 is recycled to the low-pressure column and used as reflux there.

Another part 20 of the liquid nitrogen 19 from the top condenser 17 is either, as shown in FIG. 1, taken off from the low-pressure column or is branched off directly from the line 19. This liquid nitrogen 20 is pressurized according to the invention (in the example to 14 bar) in the liquid state (pump 21) and passed via line 22 through the subcooler 15 to a product evaporator 23. The nitrogen 24 evaporated at a pressure of 13.4 bar is heated in the main heat exchanger 2 and removed as pressurized product 25. It can, if appropriate, be further compressed 26 in the gaseous state and, if desired, be mixed (29) with pressurized nitrogen 27, 28 withdrawn directly from the pressure column. In the example, approximately 50% of the total pressurized nitrogen product 29 originates from the low-pressure column 5.

On the liquefaction side of the product evaporator 23, a part 35 of the gaseous nitrogen 7 from the top of the pressure column 4 is condensed. The resulting liquid 36 is passed as additional reflux to the pressure column 4. The product evaporator 23 is designed in the example as a falling-film evaporator in which only partial evaporation occurs. Nitrogen 45 which remains liquid is recycled to the low-pressure column 5.

If required, a part of the liquid nitrogen from the top of the low-pressure column can be produced as liquid product 30. The impure oxygen 31, which is produced by evaporating the bottom-phase liquid 13 of the low-pressure column 5 in the top condenser 17 of the low-pressure column, is removed as by-product or residual gas after heating in the heat exchangers 14, 15 and 2. It can be used, for example, for regenerating an apparatus for air purification.

Refrigeration is generated in the process according to FIG. 1 by work-producing expansion 33 of a partial stream 32 of air. The expanded air 34 is introduced into the low-pressure column 5. The mechanical energy produced in the expansion machine 33 can be used for the recompression 26 of the pressurized nitrogen product 24 which is evaporated in the product evaporator 23, preferably by direct mechanical coupling of expansion machine 33 and compressor 26.

Figure 2:
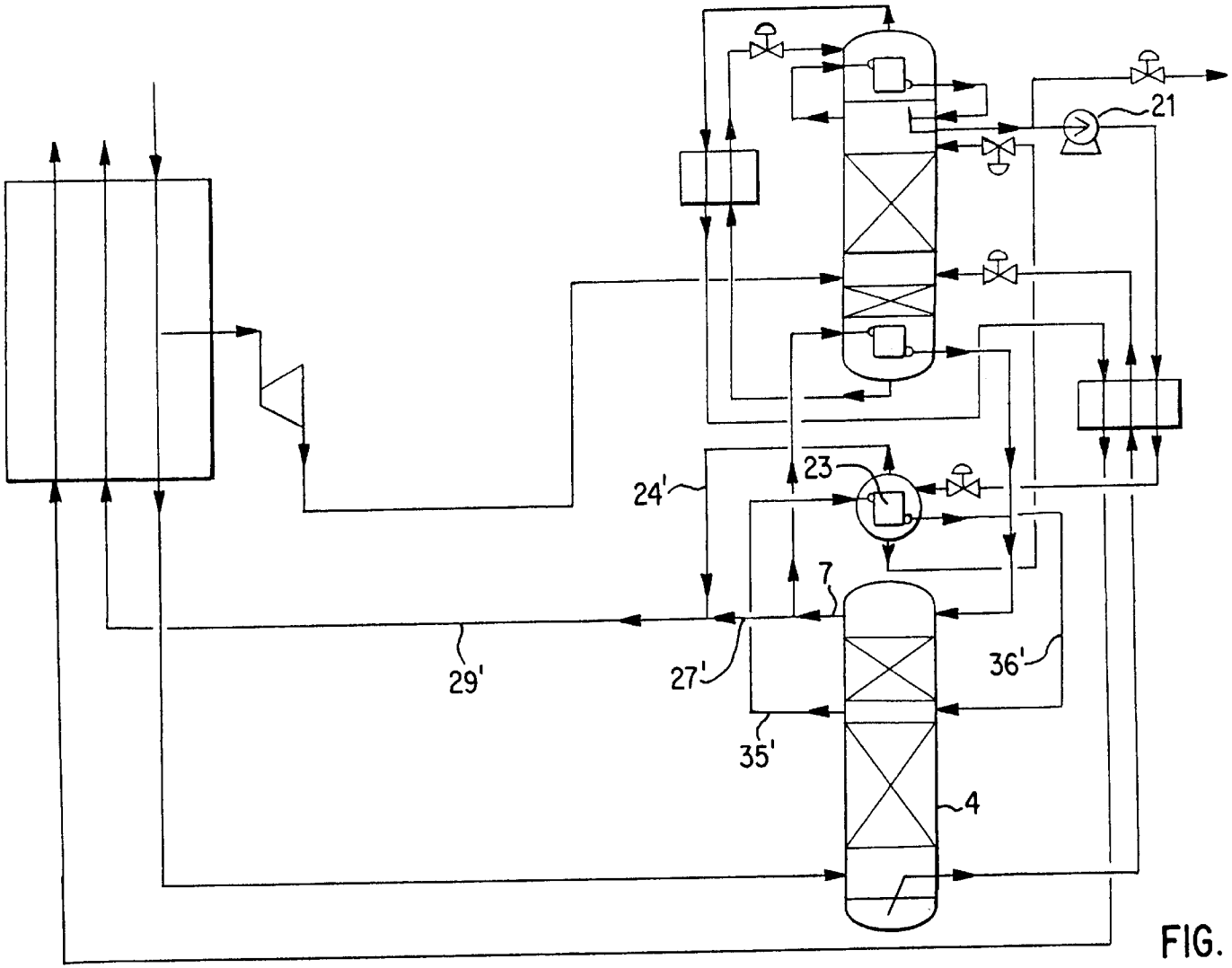
FIG. 2 shows a modified illustrative example with heating of the product evaporator by an intermediate fraction of the pressure column.

The process of FIG. 2 differs from this principally by the use of a different heat-transfer medium in the product evaporator. Instead of top gas 7 of the pressure column 4, here, a gas 35' from an intermediate point of the pressure column is passed into the liquefaction chamber of the product evaporator 23. the intermediate point is situated about 20 theoretical plates below the top of the pressure column 4, which, in the example, contains in total 60 theoretical plates.

The gas 35' still has an oxygen content of about 2 mol % and thus a higher condensation temperature than the pure nitrogen from the top of the pressure column 4 (10 ppb of oxygen). The pressure on the evaporation side of the product evaporator 23 can be correspondingly higher (14 bar instead of 13.4 bar in the case of FIG. 1). Condensate 36' produced in the indirect heat exchange is recycled to the pressure column 4 at a point corresponding to its composition, in particular the take-off point (line 35' or somewhat above)

Owing to the higher pressure in the evaporation 23, which was already produced using the pump 21, under some circumstances, recompression (26 in FIG. 1) of the evaporated pressurized nitrogen 24' to the pressure column pressure can be omitted, and the two nitrogen products 24', 27' from low-pressure column and pressure column can be mixed as early as upstream of the main heat exchanger 2 (line 29').

Figure 3:
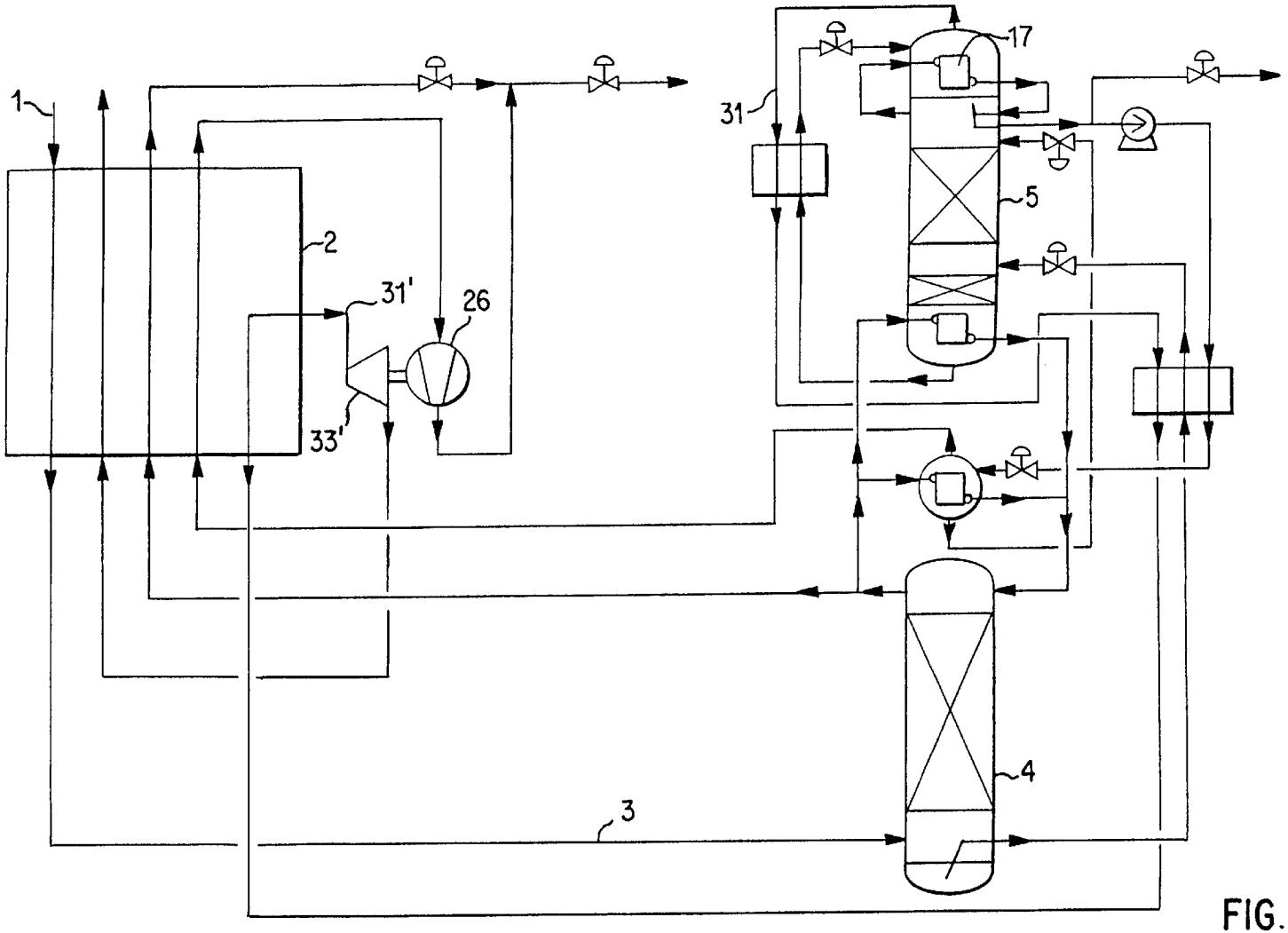
FIG. 3 shows a further variant of the example of FIG. 1 with work-producing expansion of residual gas from the top condenser of the low-pressure column.

If the double column is operated at a sufficiently high pressure (for example 8 to 15 bar), all of the feed air 3' can be passed into the pressure column 4. A process of this type is shown in FIG. 3, again only the differences from FIG. 1 being described in detail. The operating pressures in pressure column 4 and low-pressure column 5 are, in this example, 15 bar and 5 bar, respectively. Process refrigeration is generated here by work-producing expansion of vapour 31, 31' from the evaporation side of the top condenser 17 of the low-pressure column 5. If required, the expansion machine 33' can, as in FIG. 1, likewise be coupled to a compressor 26 for nitrogen product.

Figure 4:
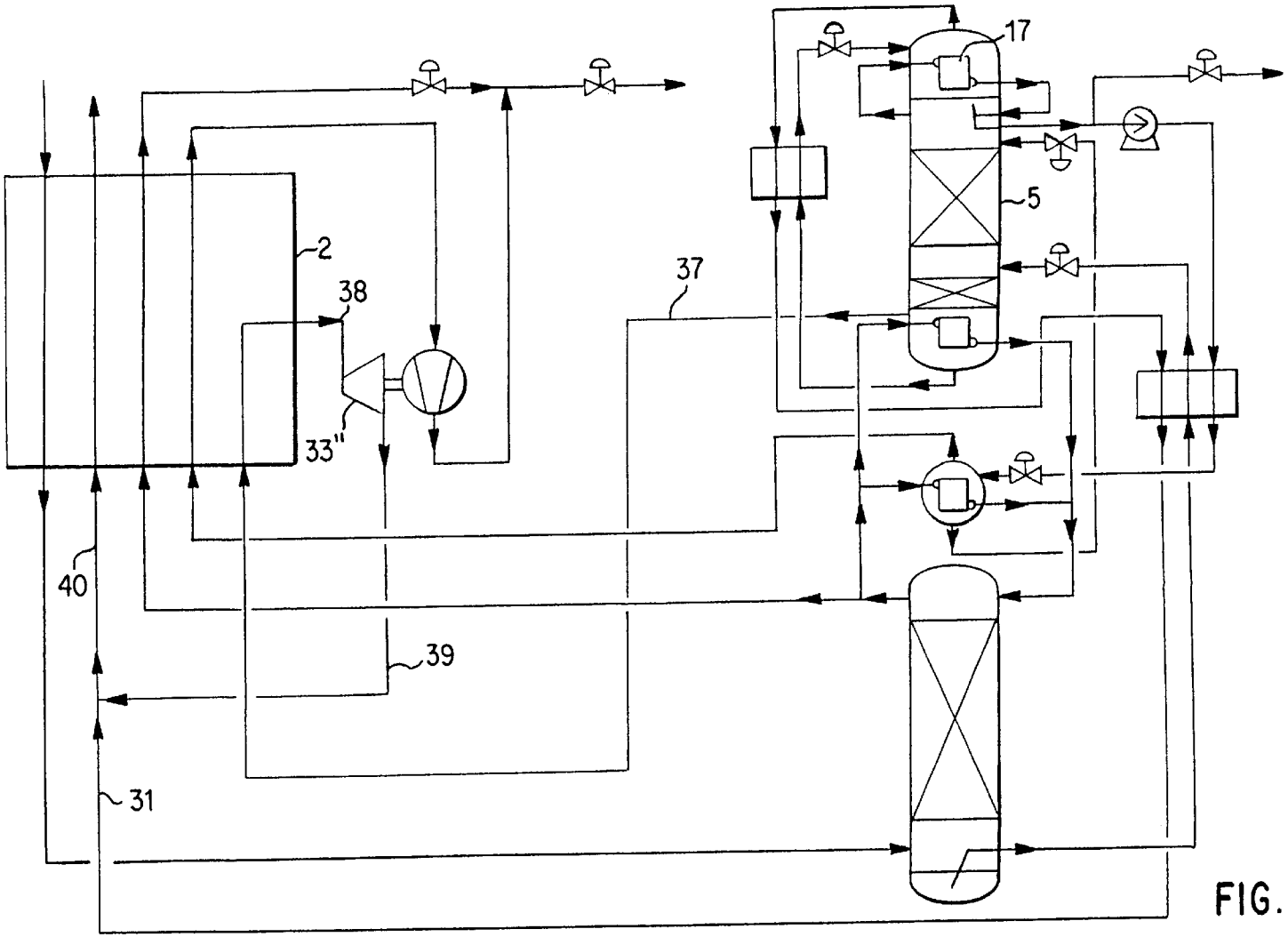
FIG. 4 shows an example with work-producing expansion of a gas from the low-pressure column.

The process of FIG. 4 is also applicable at lower pressures (example: pressure column 10 bar, low-pressure column 3 bar). Here, the expansion machine 33" is operated by a gas 37/38 which is withdrawn from the lower region of the low-pressure column 5, in particular directly above the bottom. The pressure of this gas (4.5 bar) is markedly higher than the pressure on the evaporation side of the top condenser 17 (1.25 bar). The exhaust gas 39 of the expansion machine can be heated in a separate passage of the main heat exchanger 2 and withdrawn as by-product; the additional passage is dispensed with if the exhaust gas is mixed with another fraction (vapour 31 from the top condenser 17) upstream of the main heat exchanger and the mixture 40 is heated conjointly in the main heat exchanger 2, as shown in FIG. 4.

Figure 5:
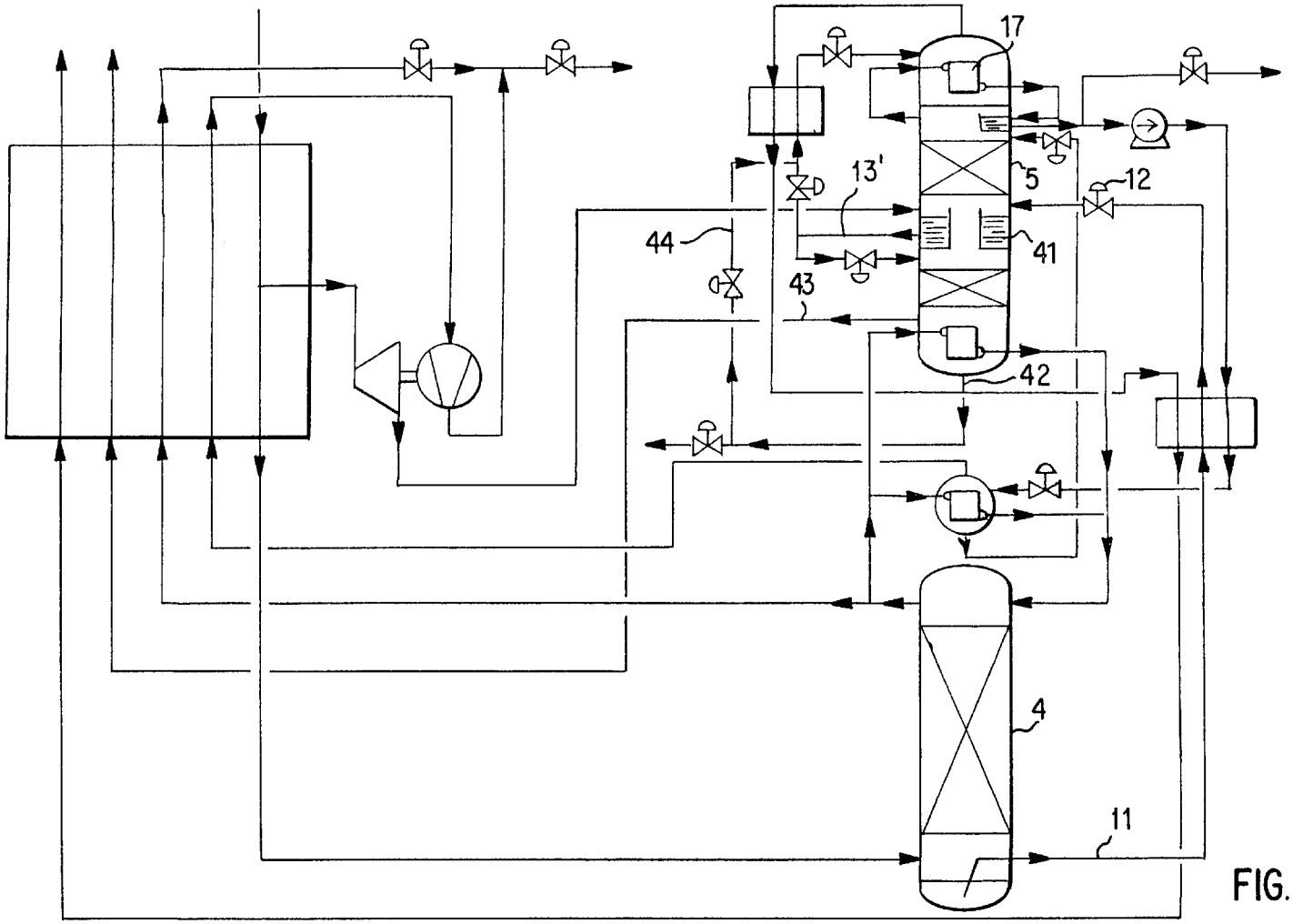
FIG. 5 shows an illustrative example with simultaneous production of pure oxygen in the low-pressure column

A process according to FIG. 5 is used if, in addition to pressurized nitrogen, pure oxygen (in the example: 99.5 mol %) is also to be produced. This variant differs from FIG. 1 by the refrigerant 13' for the top condenser 17 of the low-pressure column 5 being withdrawn, not from the bottom, but from an intermediate point, preferably from a liquid reservoir within the low-pressure column 5 which is disposed directly below the feed of the oxygen-containing liquid fraction 11 from the pressure column 4. Below the liquid reservoir which is connected to the line 13' there are about 50 theoretical plates, via which the liquid flowing down is enriched to the desired oxygen purity. The oxygen product can be withdrawn in the liquid (42) and/or gaseous (43) state. If required, a part 44 of the liquid 42 can be passed to the top condenser 17. If the oxygen is required under pressure, oxygen 42 can be brought to pressure in the liquid state by the known method of internal compression and then evaporated, for example against a part of the feed air.

Figure 6:
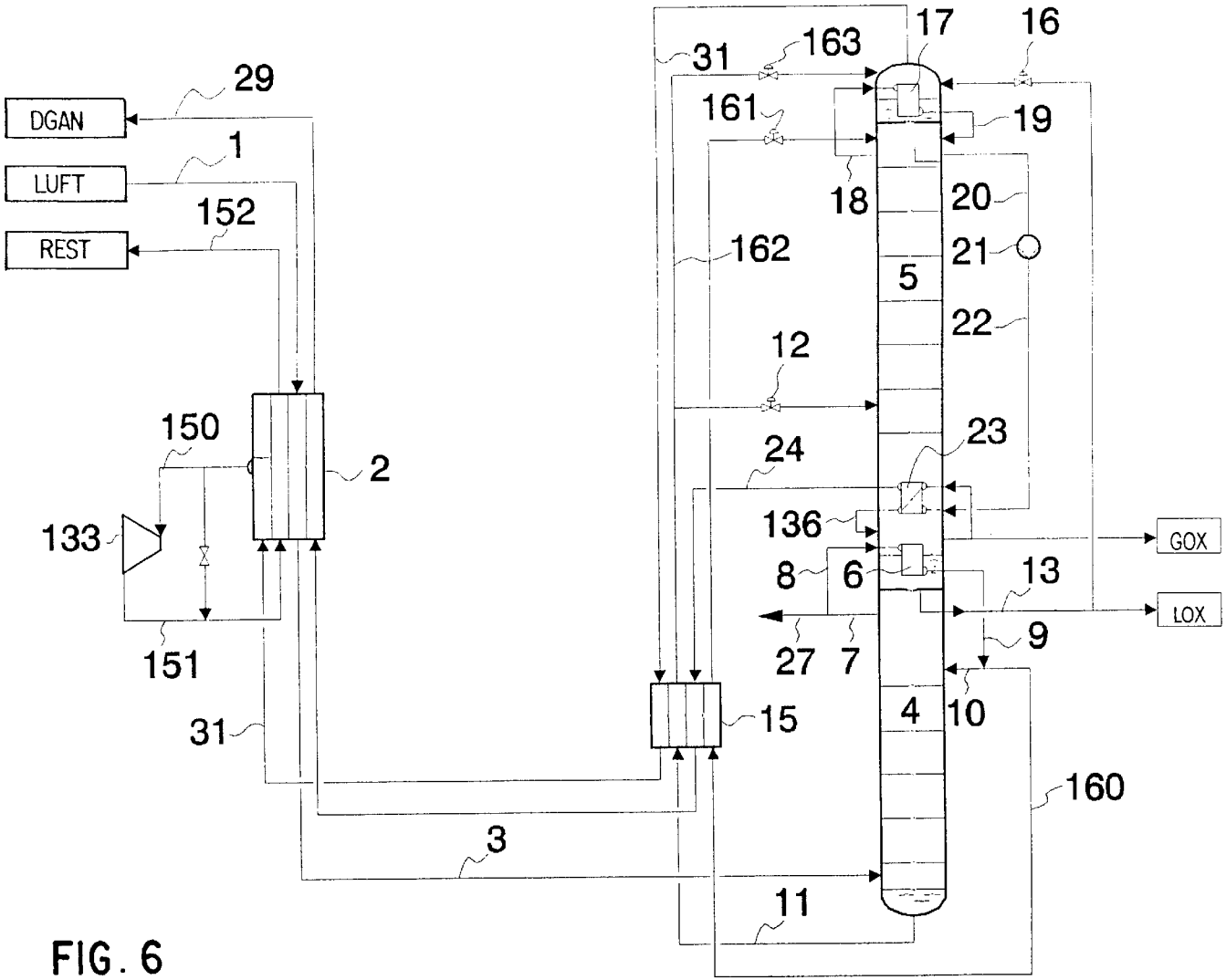
FIG. 6 shows a further illustrative example of the process according to the invention and a corresponding apparatus having a product evaporator which is disposed within the columns and operated with vapour from the low-pressure column.

The process of FIG. 6 differs in a plurality of points from that of FIG. 1. For example, it exhibits a somewhat different subcooling of the process streams, in that only one heat-exchange block 15 is shown for this purpose. A part of the bottom product 13 of the low-pressure column 5 can be produced as liquid product (LOX). A part 160 of the nitrogen 9 liquefied in the main condenser 6 can be subcooled (15) and throttled (161) into the low-pressure column 5. The bottom-phase liquid 11 of the pressure column can in part (162) be passed (163) into the evaporation chamber of the top condenser 17 of the low-pressure column. In the example of FIG. 6, the pressurized nitrogen product 24 from the product evaporator 23 is not recompressed, but is withdrawn (29) at the evaporation pressure. Refrigeration is produced here by work-producing expansion of residual gas, by subjecting at least a part 150 of the impure oxygen 31 from the top condenser 17 of the low-pressure column 5 to work-producing expansion from an intermediate temperature of the heat exchanger 2 in an expansion machine 133. The turbine exhaust gas 151 is reheated in the heat exchanger 2 and removed as residual gas 152 or used to regenerate an apparatus for the purification of the feed air. The mechanical energy produced in the expansion machine 133 can be delivered to a generator or used to compress a process fraction, preferably by direct mechanical coupling of the expansion machine 133 to a compressor which is not shown.

The main difference from FIG. 1 is the product evaporator 23. This is operated on the liquefaction side with vapour from the lower-pressure column. For this purpose, on the liquefaction side the product evaporator 23, a part of the gas situated above the bottom of the low-pressure column is condensed. The resulting liquid 136 flows back into the low-pressure column. The product evaporator 23 is, in the example, disposed within the low-pressure column. It can be designed as a falling-film evaporator in which only partial evaporation occurs. Nitrogen remaining liquid can be recycled to the low-pressure column 5.

Figure 7:
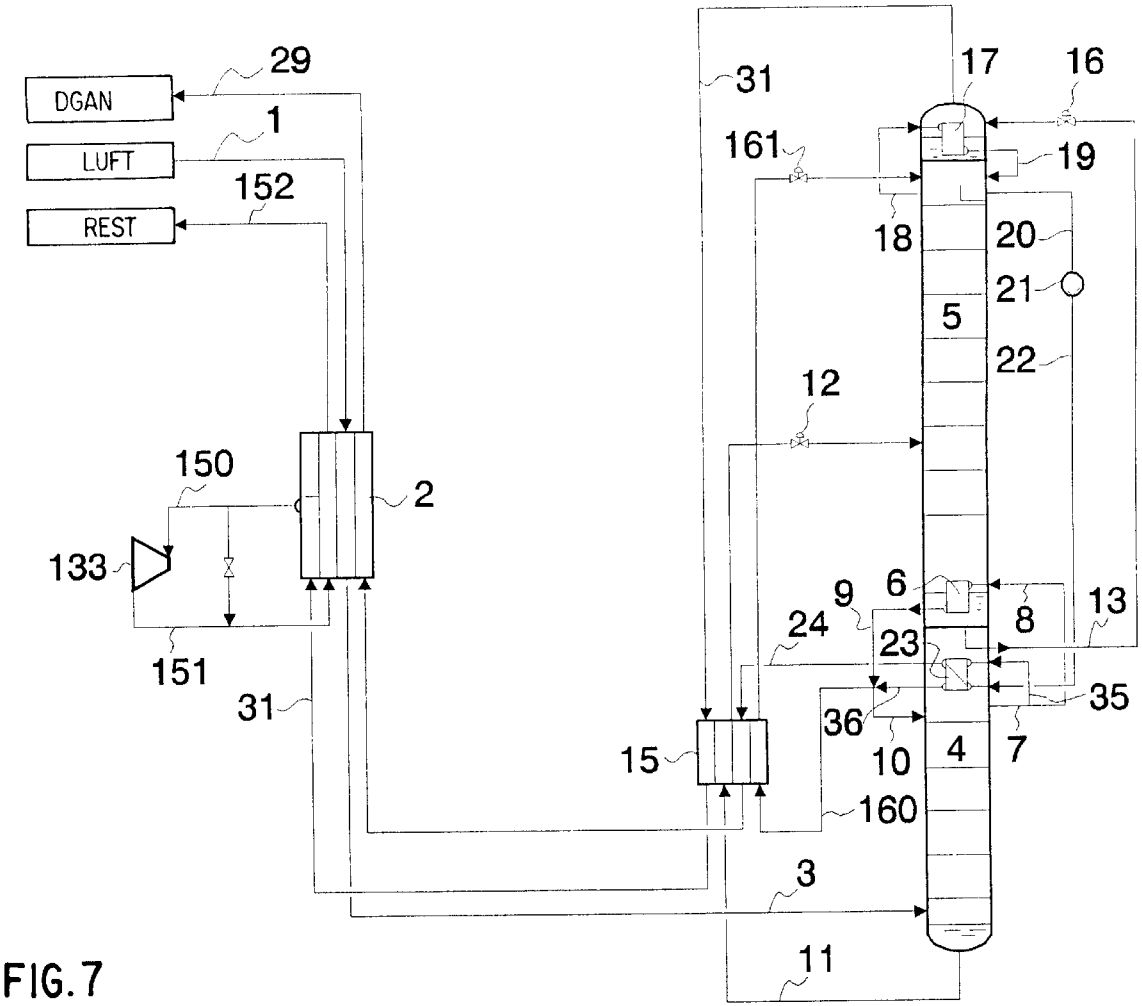
FIG. 7 shows an illustrative example having a product evaporator which is disposed within the columns and is operated by vapour from the pressure column and FIGS. 8 and 9 show illustrative examples with a product evaporator disposed outside the columns.

In the plant shown in FIG. 7, the product evaporator 23 is built into the double column in a similar manner to FIG. 6. Here, it is situated in the upper region of the pressure column 4. The liquefaction side of the product evaporator 23, similarly to the case in FIGS. 1 to 5, receives a part 35 of the gaseous nitrogen 7 from the top of the pressure column 4.

Figure 8:
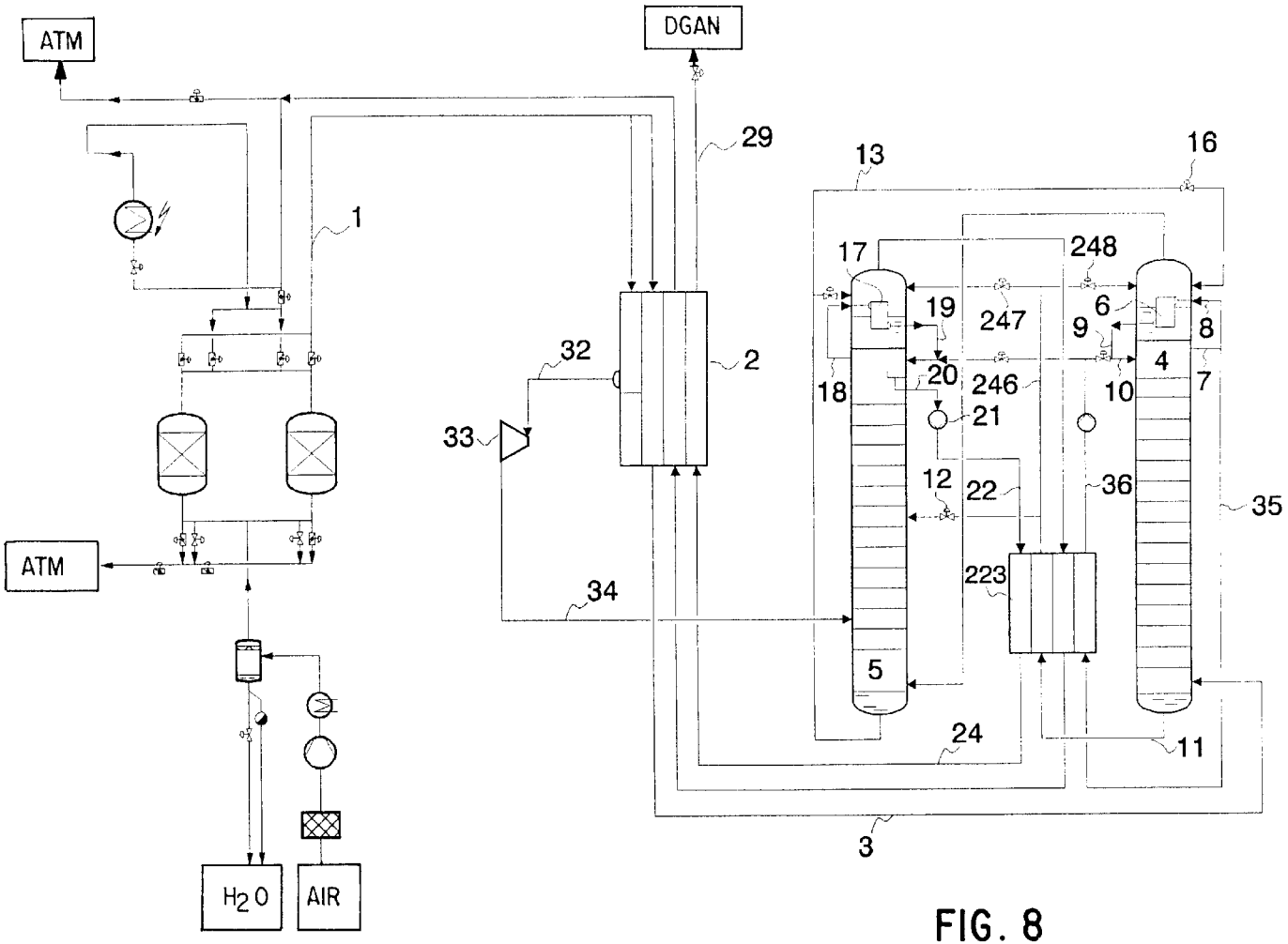

In FIG. 8, subcooler and product evaporator are integrated in a heat-exchanger block 223. In this example, a part 246 of the bottom-phase liquid 11 of the pressure column can be used for additional top cooling of pressure column (via valve 248) or low-pressure column (via valve 247). Process refrigeration is produced, as in FIG. 1, by work-producing expansion 33 of a part 32 of the feed air.

Figure 9:
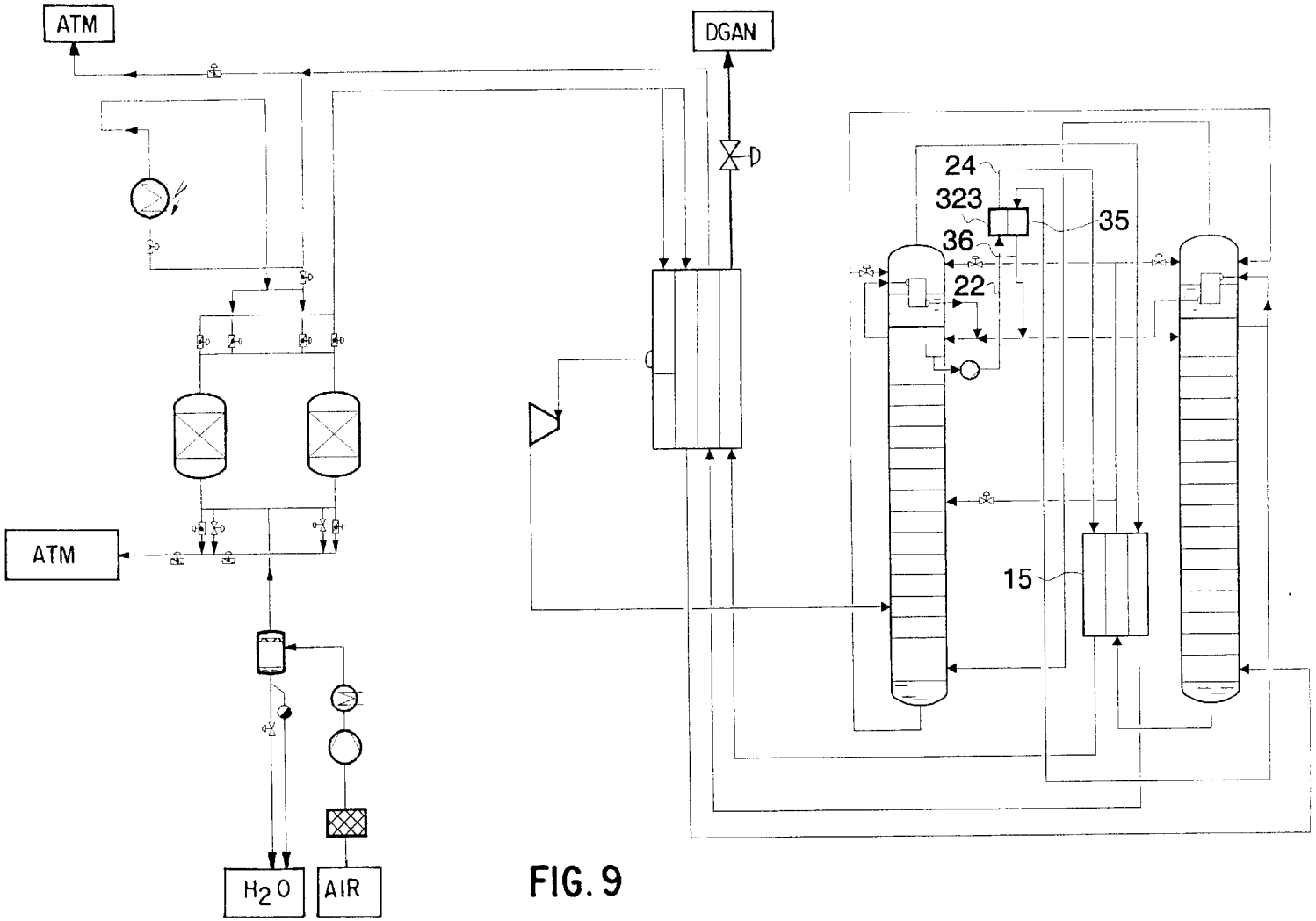

As in FIG. 8, the product evaporator 323 of FIG. 9 is constructed as a counter-current heat exchanger, preferably as an aluminium plate heat exchanger. However, in contrast to FIG. 8, it is separate from the subcooling heat exchanger 15.

Clearly, the features of the different variants of the invention shown here can be combined with one another. In each embodiment of the process according to the invention and the apparatus according to the invention, in particular in all illustrative examples, conventional rectifying plates or arranged or dumped packings can be used as mass-transfer elements in the columns of the rectification system. The combined use of different types of mass-exchange elements is also possible.

The processes of the illustrative examples and the process according to the invention in general are suitable in particular for producing high-purity nitrogen having a particularly low content of more volatile components such as helium, neon and/or hydrogen. For this purpose, in addition to the outlet lines for more volatile gases (not shown in the drawings) which are arranged on the condensers 23 and 17, other measures can be provided.

Firstly, in all of the illustrative examples, the liquid nitrogen 20 which is fed to the pump 21 can be withdrawn, instead of at the take-off at the top of the low-pressure column, at least one theoretical or practical plate below the top of the low-pressure column. For example, up to ten, preferably three to five, theoretical or practical plates can be situated between column top and modified take-off of the liquid nitrogen 20. Even if the low-pressure column is otherwise equipped with packings, these plates are preferably designed as conventional rectification plates.

Secondly, a second modification can be made in the processes of FIGS. 6 to 9, in which a liquid nitrogen stream (160 in FIGS. 6 and 7) produced in the pressure column 4 is delivered (via valve 161) as reflux to the top of the low-pressure column 5. This stream can likewise be taken off from an intermediate point which is situated one to ten, preferably three to five, theoretical or practical plates below the top of the pressure column 4.

What is claimed is:

1. A process for producing pressurized nitrogen by low-temperature fractionation of air, comprising:

feeding air to a pressure column;

feeding an oxygen-containing liquid fraction from the pressure column to a low-pressure column;

at least partially condensing gaseous nitrogen in a top condenser of the low-pressure column by indirect heat exchange with a liquid, thereby evaporating the liquid;

pressurizing liquid nitrogen produced in the top condenser or liquid nitrogen withdrawn from the low-pressure column to a pressure that exceeds the pressure of the low-pressure column; and evaporating said pressurized liquid nitrogen in a product evaporator by indirect heat exchange with a heat-transfer medium, thereby producing a gaseous pressurized nitrogen product.

2. A process according to claim 1, wherein said heat-transfer medium is a gas from the pressure column.

3. A process according to claim 2, wherein said gas is a nitrogen-containing fraction from an upper or intermediate region of the pressure column.

4. A process according to claim 2, wherein said gas is a gas from the low-pressure column.

5. A process according to claim 4, wherein said gas is an oxygen-containing fraction from a lower or intermediate region of the low-pressure column.

6. A process according to claim 1, further comprising evaporating only a part of the liquid nitrogen in the evaporator; and recycling a remaining liquid nitrogen part to the low-pressure column.

7. A process according to claim 1, further comprising expanding a partial stream of air, thereby producing work-producing energy for compressing said gaseous pressurized nitrogen product.

8. A process according to claim 1, wherein said liquid for at least partially condensing is a liquid having an oxygen content between that of a oxygen-containing liquid fraction from the pressure column and that of a bottom liquid of the low-pressure column.

9. An apparatus for producing pressurized nitrogen by low-temperature fractionation of air in a rectification system, comprising:

a pressure column;

an air feed line leading to the pressure column;

a low-pressure column having a top condenser, said top condenser having a liquefaction side that is flow-connected to the low-pressure column by a liquid nitrogen line;

a line for an oxygen-containing liquid fraction leading from the pressure column to the low-pressure column;

a product evaporator; and a product line comprising means for increasing the pressure of liquid nitrogen withdrawn from the low-pressure column or the liquefaction side of the top condenser and which directs the pressurized liquid nitrogen to the product evaporator, thereby evaporating said pressurized liquid nitrogen and providing a pressurized gaseous nitrogen product.

10. An apparatus according to claim 9, wherein a liquefaction side of the product evaporator is connected to an upper or intermediate region of the pressure column.

11. An apparatus according to claim 9, wherein a liquefaction side of the product evaporator is connected to the low-pressure column.

12. An apparatus according to claim 9, further comprising a liquid return line leading from the product evaporator to the low-pressure column.

13. An apparatus according to claim 9, further comprising an expansion machine coupled to a compressor for the further compression of the pressurized gaseous nitrogen product.

14. An apparatus according to claim 9, further comprising a liquid line for directing a refrigerant from a intermediate region of the low-pressure column or a lower region of the pressure column to an evaporation side of said top condenser.

15. A process according to claim 1, wherein said liquid nitrogen withdrawn from the low-pressure column is withdrawn at least one theoretical or practical plate below a top of the low-pressure column.

* * * * *